US005654542A

United States Patent [19]

Schubert et al.

[11] Patent Number: 5,654,542

[45] Date of Patent: Aug. 5, 1997

[54] METHOD FOR EXCITING THE OSCILLATIONS OF IONS IN ION TRAPS WITH FREQUENCY MIXTURES

[75] Inventors: Michael Schubert; Jochen Franzen, both of Bremen, Germany

[73] Assignee: Bruker-Franzen Analytik GmbH, Bremen, Germany

[21] Appl. No.: 588,209

[22] Filed: Jan. 19, 1996

[30] Foreign Application Priority Data

Jan. 21, 1995 [DE] Germany ..... 195 01 835.4

[51] Int. Cl.[6] ..... H01J 49/42

[52] U.S. Cl. ..... 250/282; 250/292

[58] Field of Search ..... 250/282, 281, 250/290, 291, 292, 293, 283, 285

[56] References Cited

U.S. PATENT DOCUMENTS

| | | | |
|---|---|---|---|
| 4,761,545 | 8/1988 | Marshall et al. | 250/291 |
| 4,945,234 | 7/1990 | Goodman et al. | 250/291 |
| 5,107,109 | 4/1992 | Stafford, Jr. et al. | 250/282 |
| 5,134,286 | 7/1992 | Kelley | 250/282 |
| 5,324,939 | 6/1994 | Louris et al. | 250/292 |
| 5,448,061 | 9/1995 | Wells | 250/282 |
| 5,479,012 | 12/1995 | Wells | 250/282 |
| 5,517,025 | 5/1996 | Wells | 250/282 |
| 5,521,379 | 5/1996 | Franzen et al. | 250/282 |
| 5,521,380 | 5/1996 | Wells | 250/282 |

FOREIGN PATENT DOCUMENTS

| | | |
|---|---|---|
| 0362432 | 4/1990 | European Pat. Off. . |
| 2278233 | 11/1994 | United Kingdom . |
| 9404252 | 3/1994 | WIPO . |

*Primary Examiner*—Jack I. Berman
*Assistant Examiner*—Kiet T. Nguyen

[57] ABSTRACT

A method for the simultaneous resonant excitation of the oscillations of ions of various mass-to-charge ratios in ion traps, particularly for the ejection of undesirable ion species, by applying RF frequencies with various frequency components to electrodes of the ion trap. The method consists in generating and storing a broadband signal for as short a time as possible so that it can be fed to the ion trap a number of times in succession cyclically, without generating undesirable interference due to phase shifts. The excitation of the ions should be as temporally constant as possible throughout the waveform period. The duration of the waveform period depends on the mass resolution required. Excitation is terminated by controlling the broadband signal gradually toward zero in a constant function.

10 Claims, 4 Drawing Sheets

METHOD FOR EXCITING THE OSCILLATIONS OF IONS IN ION TRAPS WITH FREQUENCY MIXTURES

FIELD OF THE INVENTION

The invention relates to a method for the simultaneous resonant excitation of the oscillations of ions of various mass-to-charge ratios in ion traps, particularly for the ejection of undesired ion species, by applying broadband signals with various frequency components to electrodes of the ion trap.

The invention consists in generating and storing a waveform period for a time period of as short a duration as possible in such a manner that it can be cyclically fed to the ion trap a number of times in succession without generating any undesirable interference by phase jumps between the end of the last and the beginning of the next waveform period. The excitation of the ions should preferrably be temporally constant throughout the waveform period. The necessary minimum duration of the waveform period can be calculated from the required mass resolution. Excitation is terminated by controlling the broadband signal smoothly down to zero.

BACKGROUND OF THE INVENTION

In a concurrent patent application (BFA 12/95) "Method for controlling the ion generation rate for the mass selective loading of ions in ion traps" the same subject is addressed as in this patent application. The descriptive text of the referenced patent application is therefore to be deemed included in full here.

For some purposes it is desirable to resonantly excite the oscillations of ion species of several different mass-to-charge ratios in ion traps simultaneously but to leave other ion species unexcited. For example, one can remove undesired ions from the trap by such resonant excitation and retain only ions of desired mass-to-charge ratios in the ion trap. Or one can supply ions of several mass-to-charge ratios with oscillation energy simultaneously in order to start reactions with other gas molecules or to induce self-decomposition by collisions with collision gas molecules.

A particularly important application is the mass selective loading process of ions of one or more specified m/z ratios in the ion trap. The intention is to eject undesired ions from the trap during the loading procedure to be able to fully utilize the limited storage capacity of the trap for the desired ions.

A special case of mass selective loading with simultaneous reactions of the ions involves the method of chemical ionization (CI) with selection of reaction paths, as described for example in DE 4 324 233 (Franzen and Gabling, U.S. application Ser. No. 08/277,666).

The loading of ions can be performed either by generating ions inside the trap, e.g. by injecting electrons and simultaneously introducing substance vapors, or by generating ions outside the trap and transferring them to the trap by ion-optical means.

As is known from U.S. Pat. No. 4,761,545 (Marshall, Ricca, and Wang), one can resonantly excite the oscillations of different ion species roughly simultaneously by applying mixtures of discrete frequencies to certain electrodes of the ion traps. This is possible both for magnetic ion traps (called Penning ion traps, or ion-cyclotron resonance ion traps, ICR) and for RF quadrupole ion traps (called Paul ion traps).

In the patent, the frequency mixture is calculated digitally, stored digitally, and then output to at least one electrode of the ion trap via suitable digital-to-analog converters and output voltage amplifiers. The desired frequency mixture waveform in the time domaine is calculated by inverse Fourier transformation from a specified frequency profile in the frequency domaine, whereby the frequency profile contains the oscillation frequencies of the undesired ions and excludes the oscillation frequencies of desired ions as gaps in the profile. To keep the required dynamic range for the frequency mixture amplitude values small, the phases of the discrete frequencies are shifted, from frequency to frequency, in a nonlinear but smooth function. A quadratic function of the frequency is especially recommended by Marshall et al. From a set of frequency values with amplitudes and phases in the frequency domaine, a sequence of amplitude values is generated by inverse Fourier transformation in the time domain for a waveform period. The number of amplitude values in the time domaine, and thus the duration of the waveform interval, corresponds to the number of frequency values in the frequency domaine. This method has become well-known under the acronym "SWIFT" (Stored Waveform by Inverse Fourier Transformation") in the field of ICR mass spectrometry. As described in the patent, the frequency mixture of the waveform interval is very specifically tailored, by so-called apodization, to a one-time output to the ion trap. Naturally, it can be output a number of times in succession.

However, if the SWIFT method as recommended by Marshal et al. is used for multiple subsequent output processes over long times, considerable drawbacks appear. In a single waveform interval as generated by inverse Fourier transformation, it chiefly generates a fast frequency sweep of short duration. The excitation starts at low frequencies, then passes through the series of individual frequencies essentially one after the other, and finally ends at high frequencies by decreasing the amplitudes (see FIG. 2). Consequently, an ion is only accelerated during a very short time span within the waveform interval as a whole—for the rest of the time its excitation is practically nonexistent. This behavior is generated by the nonlinear phase shift, particularly by the quadratic relationship with frequency. The frequency function in the time domaine is proportional to the derivative of the phase function in the frequency domaine so the quadratic phase shift referred to as optimal generates a linear frequency sweep. If output of the waveform period signal is repeated a number of times in succession, a sequence of short excitation pulses is imparted on an ion of given mass at the repetition rate of the waveform intervals, and in between the excitation pulses practically nothing happens to the ion. Since it is desirable to have continuous ejection of the ions during ion generation in order to avoid overloading the ion trap, this method is inadequate for the present purpose, despite its great merits in ICR mass spectrometry.

In EP 362 432 A1 (Franzen and Gabling) a digitally generated "broadband signal" was proposed for this purpose, which constitutes a mixture of discrete, continuously present frequencies. However, this document did not provide any information how the mixture of frequencies can be calculated and can be made matching the requirements of limited dynamic ranges of amplitudes and voltages, as it is necessary both for digital presentation and for further electronic processing in output amplifiers.

In U.S. Pat. No. 5,324,939 (Louris and Taylor) the method proposed by Marshall, Ricca and Wang is optimized by critical selection of the proportionality factor between the phase and square of the frequency, and by structuring the amplitudes of adjacent frequencies like a comb so that a fairly uniform presence of all the frequencies is said to be achieved. According to the figure in the patent the method provides a frequency range which begins and ends at zero and in between generates a broadband signal with a very favorable shape.

Since this patent is the closest state of the art, a critical review should be appropriate. The following phase relationship is preferred by Marshall et al., and also used by Louris and Taylor:

$$\text{Phase}=2\,\pi p\ \text{frequency}^2/n,$$

whereby n is the number of amplitude values in the waveform interval and p is a proportionality factor. The proportionality factor p will be referred to in the following as "phase factor".

If p=1, one obtains the case of a short linear frequency sweep, whereby the frequency sweep just covers the full waveform interval once (see FIG. 2). This case was regarded by Marshall, Ricca and Wang as optimal for their purposes.

If p=½, the frequency sweep covers only the first half of the waveform period, and the second half is vacant. If p=2, the frequency sweep is extended in length to double the length of the waveform interval and is pulled, in two cycles, over the waveform interval twice. The first half of the frequency sweep and the second half are superimposed. The sweep alternates between frequencies of the first and those of the second half. However, each frequency is still only output once per waveform interval in a very short time span. With larger p factors the frequency sweep is pulled over the waveform period cyclically p times (see FIG. 3 for p=11). Here too each frequency is output only once per interval within a very short time span.

If p=0, n, 2n, 3n, . . . the frequency sweep is distorted to form a single point because all the cosine functions of the frequency mixture have the same phase and all the amplitudes are superimposed at the beginning of the waveform interval. In the rest of the waveform interval, the frequency amplitudes disappear by interference. If p forms a non-simplifyable fraction r/s of the number n, that is, p=(r/s)n, r and s being integers, the frequency sweep degenerates at s or s/2 points (depending on whether s is odd or even), which are uniformly distributed over the waveform period.

By trying out large values for p it looks as if it were possible to obtain a uniform distribution of frequencies over the waveform period. In reality there are only numerous types of beat. Very slight changes in the phase factor p sometimes cause dramatic changes in the structure of the frequency mixture. Nevertheless, each frequency is only output once per waveform period in a very short time span. Only the sequence in the output of the different frequencies is mixed.

If p=(3n+1)/8, for example, it is possible to generate four frequency sweeps which take place one after the other in the waveform period, whereby each of the four frequency sweeps contains only one frequency in four.

Louris and Taylor now teach us in U.S. Pat. No. 5,324,939 that the uniformity of the presence of the frequencies over the waveform period could be proved by dividing the waveform period into two halves and subjecting the values of both halves to Fourier analysis. If p=1, it is impressive to see that the first half of the interval contains only the low frequencies whilst the second one contains the high frequencies (see FIG. 2). However, this type of investigation does not constitute proof. Repeating the frequency sweep four times as described above with p=3(n+1)/8 naturally means that both the first half and the second half apparently contain the full range of frequencies. Even the quarters seem to contain all frequencies. Because the waveform interval now is divided into four and the quarters are subjected to Fourier analysis the distribution of frequencies seems to be uniform (see FIG. 4). However, since the Fourier analyses become coarser due to the smaller number of points in the quarter intervals and one now only analyzes one frequency in four, the conclusions by Louris and Taylor are incorrect.

Furthermore, Louris and Taylor propose a comb structure of frequencies. The sharpest comb structure as suggested by Louris and Taylor involves applying a finite amplitude to only one frequency in two and omitting the frequencies in between. If one generates a waveform period from such a frequency structure by inverse Fourier transformation, the value sequences are automatically identical to the waveform period in the first and second halves. Since only half the frequencies are included, only half the quantity of values are necessary for describing them. If one now subjects the two halves of the value sequence to Fourier analysis, both halves must manifest the same frequency range (see FIG. 5). However, this does not constitute evidence that the presence of frequencies is uniform. The test method of Louris and Taylor for uniform presence of frequencies throughout the waveform period is only of very limited use although better test methods cannot be suggested here. For this reason, critical analysis is necessary every time this test method is applied.

The patent of Louris and Taylor also erroneously states, that the random selection of phases does not produce uniform a presence of frequencies.

In U.S. Pat. No. 5,314,286 (Kelley) a method is described which uses electronic noise for the purpose of ion excitation. By filtering out certain frequencies it is possible to leave ions of selected mass-to-charge ratios unexcited by filtering out their resonant frequencies from the noise. This method is much better suited to the above-mentioned purposes of mass selective loading of ions because in principle all the frequencies are continuously present over the entire time of noise, disregarding statistical fluctuations of the individual frequency amplitudes according to frequency and time. However, the patent provides no information about the definition or generation of noise.

PCT/US93/07 092 A1 (Kelley) describes a method of digitally generating the electronic noise in accordance with U.S. Pat. No. 5,134,286 by adding discrete sine-waves, although the concept of noise is restricted to frequencies with the same amplitudes. By gradually optimizing the phases of the discrete frequencies, a noise signal is generated which has a small dynamic range of amplitudes. For each frequency to be added there is a trial procedure as to which phase produces the smallest enlargement of dynamic range. Filtering can be generated by omitting the relevant frequencies during addition. The patent tells nothing about the length of the waveform interval or the addition of the sine-wave oscillations or about the possibility of creating a repeatable waveform interval. The waveform interval calculated has to have the same length as the time for which noise is to be applied to the ion trap electrodes. For an ionization cycle of 1,000 milliseconds and an output rate of 10 megahertz, which was specified for an adequately high oversampling rate for a commercially available instrument based on this patent, a very fast electronic memory is required with a capacity of 20 megabytes.

This method has the disadvantage that the arithmetic process of generating the frequency mixture is highly elaborate. Both the time interval necessary for the frequency mixture and the calculation method contribute to computation time.

There is, however, a special method for the generation of an alternating electric field with a mixture of frequencies from a digital value sequence according to DE 4 316 737 (Franzen, Gabling, and Heinen) which reduces memory requirement for the above example to 2 megabytes. Benefitting from the fact that the side band structures of the Mathieu equation agree with those of the digital frequency generation, oversampling can be dispensed. If the Mathieu side band oscillations of the ions in the RF ion trap match the side bands of the digital frequency generation the motion of the ions is not undesirably disturbed. The method reduces not only the memory requirement for storing the waveform but also the computation requirement, and requirements for the speed of the D/A converters.

DISADVANTAGES OF PRIOR ART

The rate of ion generation depends on substance concentration. In many practical cases, particularly when a gas chromatograph is coupled to a mass spectrometer (GC-MS), the concentration of the analyte fluctuates considerably; the concentrations may cover more than five orders of magnitude. The same is true for other "hyphenated" methods, e.g., by coupling the mass spectrometer with other substance-separating methods, but also in investigations of pyrolytic or explosive processes.

From U.S. Pat. No. 5,107,109 (Stafford, Taylor, and Bradshaw) it is already known that it is necessary to limit the number of ions inside the ion trap to avoid negative influences of space charge on the process of scanning. The ion number is regulated in all practical applications by controlling the ionization time, although control of the intensity of the ionization process has also been proposed.

The generation of ions until the trap is optimally filed can therefore be of shorter or longer duration depending on the concentration of the analysis substance and, for example, can range from 10 microseconds to 1,000 milliseconds, as is the case in commercially available ion traps. The process of excitation to eliminate the undesired ions must therefore be able to operate continuously and effectively inside these time spans. For long ionization times, this is no severe problem. The above-mentioned patents do not teach this situation explicitly but to the expert it is clear that cyclic repetition of the waveform period is possible under certain conditions.

However, in experiments it has become evident that for the mass selective loading of ions, it is by no means adequate to control only the final number of ions in the ion trap. For high concentrations of substance vapors, and thus for short ionization times, the high number of ions generated in short times hinders the ejection process. Selective loading fails completely if the ejection rate of the ions is too small compared with the generation rate.

In particular it has been established that for substance mixtures which contain very many light substance molecules such as pyrolytically generated substance mixtures the loading of heavier ions in the ion trap is considerably impaired or completely prevented.

OBJECTIVE OF THE INVENTION

A method has to be found to mass selectively load individual ion species into an ion trap by optimum ejection of the undesired ion species during ionization such that the process of ejection also operates at high concentrations of the substances to be ionized.

In particular, undesired light ion species must be ejected very quickly because they specifically impair loading of heavier ion species.

The mass resolution for the ejection process of the undesirable ions must be kept as independent as possible of substance concentration. The method of ion ejection should be fast, should use only little electronic memory to store the frequency mixture, and should require low dynamic ranges as well for the stored amplitude values, as for the digital-to-analog converters, and for the electrical post-amplifiers. For calculating the value sequence representing the waveform interval for the frequency mixture, the computation times required should be as short as possible. During continuous investigations it should be possible to calculate new frequency mixtures without having any major detrimental effect on the measurement procedure.

Interrelationships and fundamentals for understanding the invention

In procedures with mass selective loading of ions, the generation rate for the selected ion species may completely differ from the total generation rate of substance ions. The generation rate for the desired ions may be exceptionally low whilst the total generation rate of ions which can be stored inside the ion trap above the cut-off limit (including the undesirable ions) may be extremely high. Inside the ion trap, an ion population equilibrium is achieved which is determined by the total ion generation rate on the one hand and by the ion ejection rate on the other.

In experiments it has been established that high ion generation rates and non-optimized ejection rates first start to deteriorate the mass resolution of the ejection process, thereby slowing down the ejection process, thus increasing the population of ions, and thereby finally stopping the ejection process in total.

It is the space charge of the ion population equilibrium which effects the ejection so substantially that mass selective loading can no longer take place. For this reason, the influence of space charge on mass resolution and the process of ion ejection will be examined in greater detail below. It must be the aim to raise the rate of ion ejection to the physical maximum in order to keep the ion population equilibrium to a minimum.

The resonance width of the oscillating ions, and hence the mass resolution of a single resonant frequency in the frequency mixture, depends (a) on the field conditions inside the ion trap, i.e. (a1) on space charge and (a2) on field distortions by ion trap design, and (b) on the time for which the ions are subjected to the frequency mixture until they are eliminated from the storage process by collision at the electrodes of the trap. The time of ejection is again very largely dependent on the voltage of the frequency mixture, but also on the mutual influence of adjacent frequencies on the excitation of ions.

(a1) Space charge effects. The space charge causes a shift in the resonance frequency and a widening in the resonance curve. The widening has roughly the same values as the shift During a moderate loading process of the ion trap, controlled such that the mass resolution does not yet suffer during mass-sequential ejection, the mass spectrum already shows a shift of mass line 200 u of about 0.1 u (u=atomic mass unit). The ions oscillate at about 100 kHz in a trap having a drive frequency of 1 MHz, and the shift corresponds to about 0.05 kHz, if the cut-off mass is kept at 50 u. If the ion trap is overfilled 10 times, there are shifts and widenings of the resonance frequency of about 0.5 kHz, equivalent to 1 u. If the overfilling is much more than ten times, as may very easily occur at high generation rates and low ejection rates, shifts and widenings of the resonance frequencies of 20 to 30 kHz can be demonstrated. Each mass selective loading is then rendered impossible. Space charge effects have by far the strongest influence on mass resolution.

(a2) Field distortions by trap design. Superimposed multiple fields cause the resonance frequencies to be dependent on oscillation amplitude. All commercially available ion traps are superimposed with weak octopole fields in order to improve the mass resolution during scan. In customary RF ion traps which are operated at a drive frequency of about 1 MHz, an ion which oscillates at about 100 kHz suffers a shift in its resonance frequency of about 1.5 kHz if it oscillates to the end cap of the ion trap. At half the oscillation amplitude the shift is only approximately 0.4 kHz because it is the octopole which is largely responsible for this effect. The octopole potential increases in the axial direction of the ion trap according to the third power of distance, whilst field strength and the associated frequency shift increase according to the square of distance. For the ion indicated above and having a mass of 200 u the full shift of about 1.5 kHz is equal to about 3 atomic mass units on the mass scale.

For ions subject to substantial oscillations, as is the case during the loading process, mass resolution is therefore limited to roughly one atomic mass unit. For ions which are located in a small cloud at the center of the trap after a damping period, the mass resolution is very good and is well below one tenth of an atomic mass unit.

The field distortion itself does not cause any widening of the resonance curve for an individual ion which is oscillating at a constant amplitude; only in the temporal integration of the motions of an ion during its damping cycle a smearing of the resonance profile exists.

For ejection of the ions the frequency shift caused by the amplitude amplification produces a particular difficulty about which no investigations have been published. If the ion increases its oscillation amplitude by excitation with a frequency, its oscillation frequency increases and it tends to enter the resonance range of the next higher frequency in the frequency mixture. However, it depends on the relationship between the phases of the two adjacent frequencies as to whether the ion is increasingly excited by the next frequency, or whether the next frequency even has a damping effect on its oscillation. Further excitation with corresponding increase in amplitude must wait until the phase of the next frequency is approximately equal. However, in one waveform interval of the mixture the phase differences of two adjacent frequencies sweep through a full circular cycle. Consequently, in each waveform interval there is only one optimal point in time for acceptance of further excitation by the adjacent frequency. It is a matter of chance whether further excitation by the adjacent frequency can take place in the same waveform interval. For complete ejection, therefore, on a statistical average the output of the mixture is necessary over just as many waveform intervals as adjacent frequencies are required for complete ejection.

The speed of ejection thus has a physical limit, usually about three waveform intervals are needed to eject an undesired ion.

(b) Residence time of the ions in the frequency field. If the voltages of the frequency mixture are amplified so that an undesirable ion leaves the ion trap after only 100 microseconds, the frequency resolution can only be (by rules of Fourier) about 10 kHz (equivalent to 20 atomic mass units in the above example). This ion experiences only 100 oscillations of the drive frequency and (at a resonance frequency of 100 kHz) only 10 secular oscillations in the ion trap. At a mean residence time of 1 millisecond, which is ten times larger, the frequency resolution is approx. 1 kHz, roughly corresponding to two atomic mass units. At a residence time of 10 milliseconds a mass resolution of about ⅕ mass unit is achieved. This behavior can be explained by the fact that an excitation frequency which does not exactly coincide with the secular frequency generates a beat in the oscillation of ions. The amplitude of the beat antinodes depends on voltage and on the difference between the secular frequency and the exciting frequency. If the amplitude of the beat antinode is larger than the electrode spacing, the ion is eliminated from the storage process. There is thus a reciprocal relationship between the voltage of the resonant frequency and the frequency resolving power. High voltages in the frequency mixture prevent good resolving power in frequency and mass.

From these explanatory remarks it follows that for optimal loading processes without any significant ion losses one cannot really expect any mass resolution of the ejection processes at all which is better than approximately one mass unit, at masses in the range of 100 u to 400 u. Also it follows that the ejection rate is limited by the fact that more than one waveform intervals are necessary to eliminate the ions from the ion trap. The number of waveform intervals depends on the spacing of the frequencies in the mixture, the larger the spacing the lesser waveform intervals are needed.

In practice, the mass resolution tends to be much worse than one mass unit. The necessarily very wide oscillation amplitude at the beginning of ion loading and the overfilling of the ion trap prevent a good mass resolving power, irrespective of whether the ions come from outside or are generated inside the ion trap.

For this reason it is advisable to proceed in two steps in the mass-selective loading of ions. The first of the two steps must take place during ion generation and continue for a short time after it has ended until all the undesired ions have been eliminated from the trap. This first step is preferably performed with a rather wide frequency gap for the desired ions, whereby it has to be accepted that undesired ions with masses adjacent to that of the desired ion species remain inside the ion trap. The second step then follows after an ensuing damping time, which assembles the ions at the center, and is performed with the desired mass resolution. In principle the operation procedures for both steps are the same but in the second step a different frequency mixture is used with a better mass resolution.

SUMMARY OF THE INVENTION

It is the basic idea of the invention to use a waveform interval of the frequency mixture in the time domaine with as short a duration as possible and to output the frequency mixture of this waveform interval cyclically, repeating it as often as necessary. This procedure requires that all frequencies of the mixture have exactly an integer number of sine wave periods in the waveform interval so that a frequency ends with the same phase as it starts in the waveform interval. Only the frequently repeated output of this very short waveform period can maximize the ejection rate.

A short waveform interval is determined by a rather large frequency spacing in the waveform mixture. A large frequency spacing necessarily means a rather coarse mass resolving power for ion ejection. Since the mass resolution is already relatively poor in the mass selective loading process for physical reasons, a very short waveform period can be designed without any other disadvantage.

The stored waveform interval fulfilling the above requirement of undisturbed repeatability will be referred to in the following as "waveform period" or "mixture period" because the frequency mixture of the waveform period can be output repeatedly without any drawbacks or disturbances. There are no phase jumps of individual frequencies if the waveform is repeated without any time delay. There is no disturbance in excitation due to undesirable frequencies which might be generated by phase jumps.

Only through very short waveform periods for the frequency mixture and their frequent repetition is it possible to eject undesired ions uniformly and fast over the time because forewarding of the resonant excitation process to the next frequency of the mixture, as is necessary in commercial ion traps, can only ever take place once per waveform period.

As already said, for repeatability of the signal without disturbances it is necessary that the discrete frequencies included in the mixture each meet the prerequisite that always exactly integral numbers of oscillation cycles fit into the waveform period. Only then do the individual frequencies follow on in cyclic repetitions without any phase jumps. The phase position itself is not so important—due to the integral number of cycles it is exactly identical for each frequency at the beginning of the waveform period and at the end. Consequently the frequency mixture can be repeatedly output and act for any length of time.

Repeatability of the waveform periods can be taken for granted if the mixtures are generated by FFT methods but for the procedure of adding individual sine-wave curves this condition has to be fulfilled specifically.

When inverse Fourier transformation is used waveform periods with cyclic repeatability occur without any special action. In using FFT methods (Fast Fourier Transform after Sande-Tukey or Cooley-Tukey), however, the waveform periods are limited to such value sequences, the length of which just form full powers of two. For output rates of 1 MHz (at an ion trap drive frequency of 1 MHz), for example, waveform periods may have the length of 0.512, 1.024, 2.048 or 4.069 milliseconds, with frequency spacing of 2, 1, 0.5 or 0.25 kilohertz. A very preferable waveform period has a length of 1.024 milliseconds and a frequency spacing of 1 Kilohertz, giving a mass resolution of roughly 1 u for mass 200 u, oscillating at about 100 Kilohertz.

In addition, one should endeavor to distribute the frequencies of the mixture uniformly over the time within the waveform period.

To ensure that the frequencies can act on the ions continuously and to prevent peculiar interference patterns forming within a waveform period, the phase positions of the individual discrete frequencies are simply selected at random. This method, not described hitherto, limits at the same time the dynamic range of amplitude values for the frequency mixture. The limitation is not as well as with a quadratic phase function but works sufficiently well In series of tests it has been demonstrated that further optimization of the dynamic range of the amplitude values of the frequency mixture, as proposed in PCT/US93/07 092 A1, is quite unnecessary. If 1,000 sine-wave curves with randomly selected phases are added, the maximum amplitude value occurring fluctuates only minimally. The subsequent extraction of frequencies to create frequency gaps has little influence on the dynamic range, unlike a signal which is optimized to the lowest dynamic range. If a mixture optimized according to PCT/US93/07 092 A1 is subsequently provided with gaps, the dynamic range deteriorates in an unpredictable manner, and the prior optimization is destroyed.

Generation of frequency mixtures with repeatable waveform periods has so far not been described for calculation methods using simple additions of sine-wave curves. The conditions for this have been stated above.

The introduction of optimally short waveform periods for cyclic repetition offers further advantages. The demand for electronic memory capacity is reduced and the computation (or subsequent processing) of the frequency mixture is facilitated because there are much fewer stored values. In the case of FFT-generated value sequences with numbers to the power of two there is also the advantage that the stored values can be easily addressed for cyclic outputs to on-line digital/analog converters.

If the repeated output of the frequency mixture stops abruptly considerable frequency interferences would appear. Therefore, it is another idea of the invention to smoothly reduce the amplitude of the frequency mixture to zero, when the repeated output has reached its end. This can be achieved, for example, by controlling the electronic post-amplification for the frequency mixture. This method is called "apodization". It is well-known from U.S. Pat. Nos. 4,761,545 and 4,945,234, but used in these patents on both sides of each waveform period, thus producing inferior temporal utilization.

This method of repeated output of a short waveform period with rather coarse mass resolution may require a subsequent refinal. For such subsequent steps with better isolation of the desired ions a somewhat longer waveform period may be used, although here too the length of the waveform period should be selected so that it is as short as possible.

For the second stage of improved ion isolation the frequency mixture can also be gradually run up from zero to the desired amplitude value.

A further idea of the invention is to limit or regulate the ion generation rate when using the method of mass-selective ion loading in the ion trap, in order to minimize the negative influence of space charge on mass resolution. This limitation or regulating can be performed by restricting the generation process, but also by cyclic interruption of the generation process. (The concurrent patent application BFA 12/95 is particularly dedicated to regulating the generation process).

Another idea of the invention is to keep the frequency spacing of the mixture from discrete frequencies unequal and to vary them according to the mass resolution requirements. Since at higher frequencies (acting on lower ion masses) the mass spacing decreases on account of the reciprocal relationship of frequencies and masses, the frequency spacing can increase here.

Naturally one must ensure that there must always be a whole number of frequency cycles in the waveform period. Any change can therefore only be performed in steps. Since when spacing is changed the power density along the frequencies also changes, the latter can be maintained constant by correcting the amplitudes of the added frequencies.

Doubling, tripling or quadrupling the frequency spacing shortens the repetition cycle for these frequencies because the frequencies can then be output in a waveform period twice (or more) in succession and thus cause faster ejection of the ions involved. The phases of adjacent frequencies can then coincide twice (or more times) per waveform period and thus cause acceptance of excitation by the adjacent frequency. This effect should be regarded as particularly positive because these high frequencies eject the low mass ions. As already mentioned, the low mass ions often prevent loading of higher mass ions because the latter are not stored as efficiently in the pseudo potential well and are particularly impaired by the space charge of smaller ions.

It is a further basic idea of the invention to use excitation with a frequency mixture in accordance with this invention to excite selected ions in such a way that they take on a wide oscillation amplitude inside the ion trap and thereby, on impact with a collision gas, fragment into daughter ions. For this purpose of excitation it is necessary to use a frequency mixture with properties indicated in this invention in order to provide a favorable forewarding of further excitation to the next frequency. The ions selected for fragmentation can be already isolated by one of the above methods, though it is also possible to fragment non-isolated ions.

Several ion species may be simultaneously fragmented by this method with or without prior isolation. For instance, it may be useful to establish whether certain daughter ions are formed from one of several parent ions, as is favorable for generic analyses. Per example, the various molecular ions of substituted phthalates can be fragmented simultaneously to indicate the presence of phthalates (frequently used as plasticizers) by the formation of the key daughter ion of mass 149 u. The environment around mass 149 u can in turn be cleaned of any ions by the method based on this invention during ion loading.

DETAILED FIGURE DESCRIPTIONS

Figure 1:
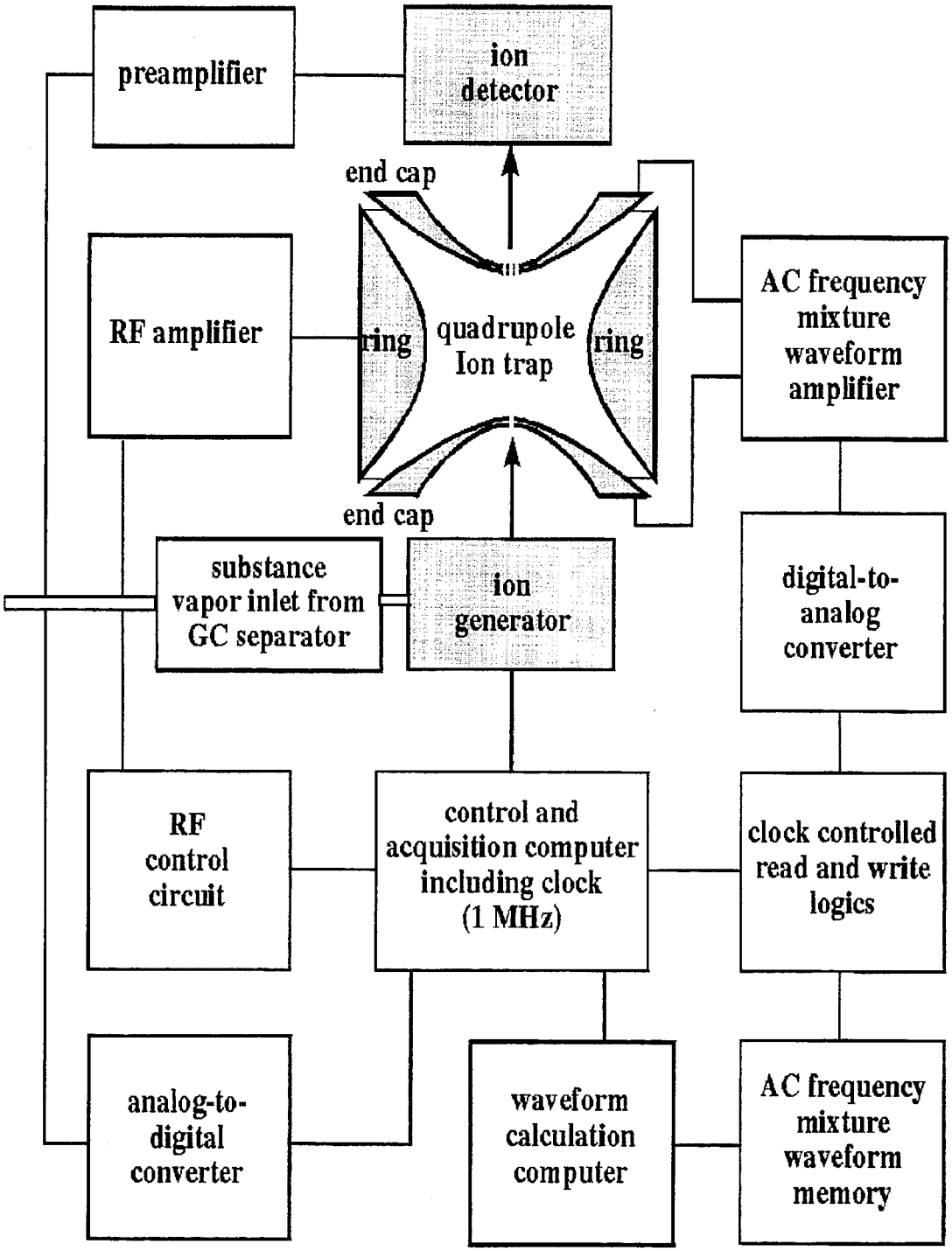
FIG. 1 exhibits a block diagram of a device which can be used for this invention.

A favorable device for this invention is shown in the block diagram of FIG. 1.

FIG. 1 displays a configuration as can be used for outputting the frequency mixture to an RF ion trap after Wolfgang Paul. Via the ring electrode the ion trap is supplied with an RF storage field the necessary drive voltage of which is generated by an RF control circuit and an RF amplifier. The frequency of the RF drive voltage is controlled by a dock generator, usually the frequency amounts to roughly one megahertz. The RF field inside the ion trap, generated by the RF drive voltage, permits storage of ions with masses above a cut-off mass which depends linearly on the amplitude of the RF drive voltage.

An ion generator serves to generate ions of the admixed substance vapors during the ionization phase. The ions can be generated in the ion generator itself, as is here the case, and then transferred to the ion trap. The ion generator then operates as an ion source, and the substance vapors are introduced to the ion generator. Substance vapors will be supplied via an inlet system which—in this case—is coupled to the output of a GC separator device which supplies the substances in form of time-separated substance peaks. Thus the concentrations of the substances in the carrier gas fluctuate from zero to high values and back, the dynamic range between just detectable traces and full concentrations covers usually more than five orders of magnitude.—On the other hand (not shown here), the ionizer may only produce an ionizing radiation beam which generates the ions in the ion trap itself. In this case the substance vapors are introduced to the ion trap. The ionizing radiation may consist of electrons, photons, or primary ions.

One of the most essential applications of the excitation of several ion species simultaneously is the mass selective loading of desired ion species, ejecting undesired ion species. But this application of the invention is not the only application, as stated above.

For the simultaneous excitation of ion species, the amplitude values of the mixture waveform period, which are saved in a digital data memory, are transferred to (written to) a digital-to-analog converter by a read and write logic circuit at a rate derived by the clock generator. The amplitude voltages produced by the digital-to-analog converter are then transferred to the two end caps via an AC excitation waveform output amplifier. Since the same clock generator is used for both processes, and either the basic clock frequency or a multiple thereof is used, all side bands of the digital frequency generation coincide with Mathieu side bands of the resonantly excited ion oscillations. No ion which is not intended to be excitated, sees any excitation, neither by direct resonance, nor by sideband resonances, so the unavoidable side bands of digital waveform generation do not disturb the motions of those ions. The waveform period is then output cyclically as long as necessary for the purpose of excitation.

The sequence of values of the mixture waveform period stored in the digital data memory may be generated in a separate computer, as is shown in this block diagram of FIG. 1, but it may also be calculated in the control computer.

Aside from this representation it is also possible to output the waveform voltage to one ion trap end cap electrode only and to keep the other end cap at ground potential. Then, by comparison with supply from both end caps, a dipole field at half the voltage is superimposed with a quadrupole field at half the voltage. The quadrupole field scarcely has any effect so it can be neglected. For the same dipolar excitation effect, the voltage thus has to be doubled.

As stated above, it may be necessary for mass selective loading of desired ion species in the ion trap, to control the ion generation rate. The generation rate of the ions depends on the partial pressures (or concentrations within the GC carrier gas) of the substances introduced. In FIG. 1, the control and acquisition computer controls the ionization process of the ion generator. To control the generation rate either the intensity (or strength) of a variable ion generation process, or the duty cycle of a pulsed ion generation process of constant strength may be controlled. As feedback parameters for control, measurements of the generation rate in a directly preceding integrating test spectrum (or "prescan") measurements (in a process shown in FIG. 2), measurements of the ions ejected during mass selective loading via the ion detector (in a process shown in FIG. 3), measurements by external substance concentration measurements, but also measurement results from previous spectrum scans may be used. For most of the methods, the ion detector signal, amplified by an pre-amplifier and digitized by an analog-to-digital converter may be used, not only for the final mass spectrum acquisition, but also for the measurement of the ion generation rate.

Figure 2:
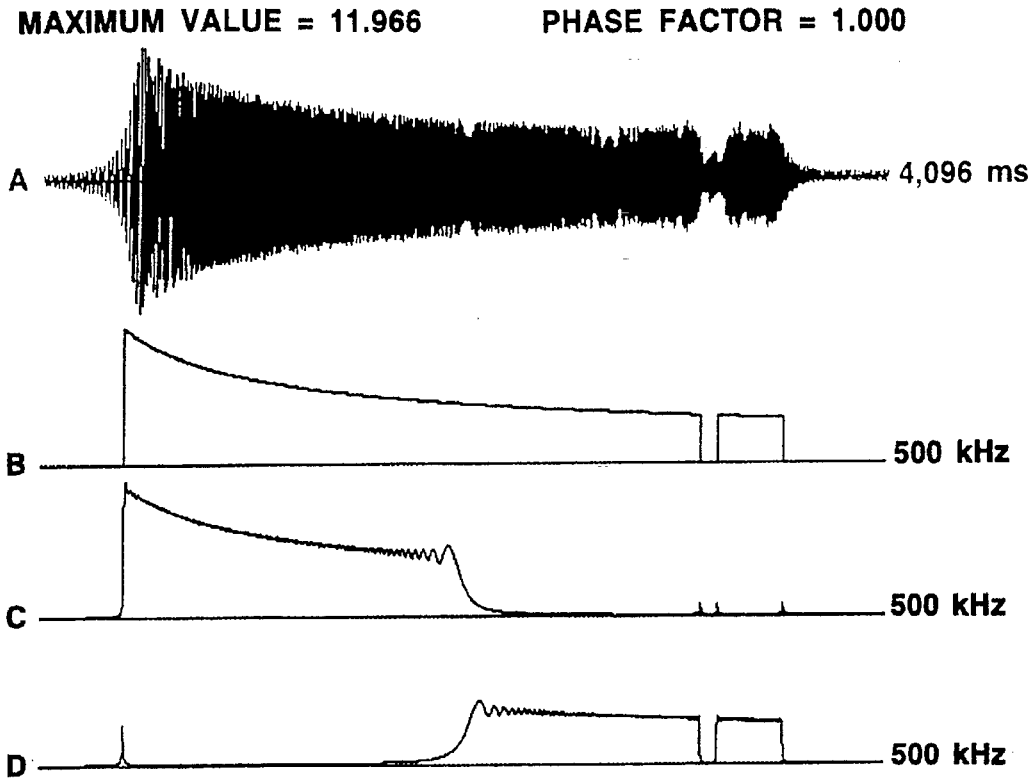
FIG. 2 presents, in track A, a waveform period according to Marshall et al. with phase factor=1. In tracks B to D, FFT analyses of the full waveform period, of the first half, and the second half are shown, respectively.

FIG. 2 shows the optimal case of excitation as recommended by U.S. Pat. No. 4,761,545. This case is, however, not regarded as optimal for the present invention, and is only shown for comparison purposes.

Track A in FIG. 2 shows the frequency mixture with a fast frequency sweep for a waveform period of 4.096 milliseconds, as is generated in the relationship $$\text{Phase}=2\pi p\ \text{Frequency}^2/n$$

by selecting a phase factor p of 1. Marshall, Ricca and Wang regard this selection as optimal for their purposes.

Track B in FIG. 2 shows an FT analysis of the frequency spectrum from track A. Since FFT analysis is based on the fact that the interval is cyclically continued infinitely, the frequency spectrum is identical to the output spectrum (not illustrated) from which mixture A was generated. Here, by contrast with other descriptions which are always based on a constant amplitude, an amplitude function for the frequency mixture was used in which the amplitude was altered in proportion to the root of mass (inversely proportional to the root of frequency). This variable amplitude exhibits the frequency sweep in track A, to be seen from the amplitude characteristic, much more clearly than the usual representation.

Tracks C and D in FIG. 2 show the FFT analyses of the left and right-hand waveform halves of the frequency mixture in track A. Here too one can see the frequency sweep because the Fourier analysis of the two halves of the waveform period also produces the two halves of the frequency spectrum.

Figure 3:
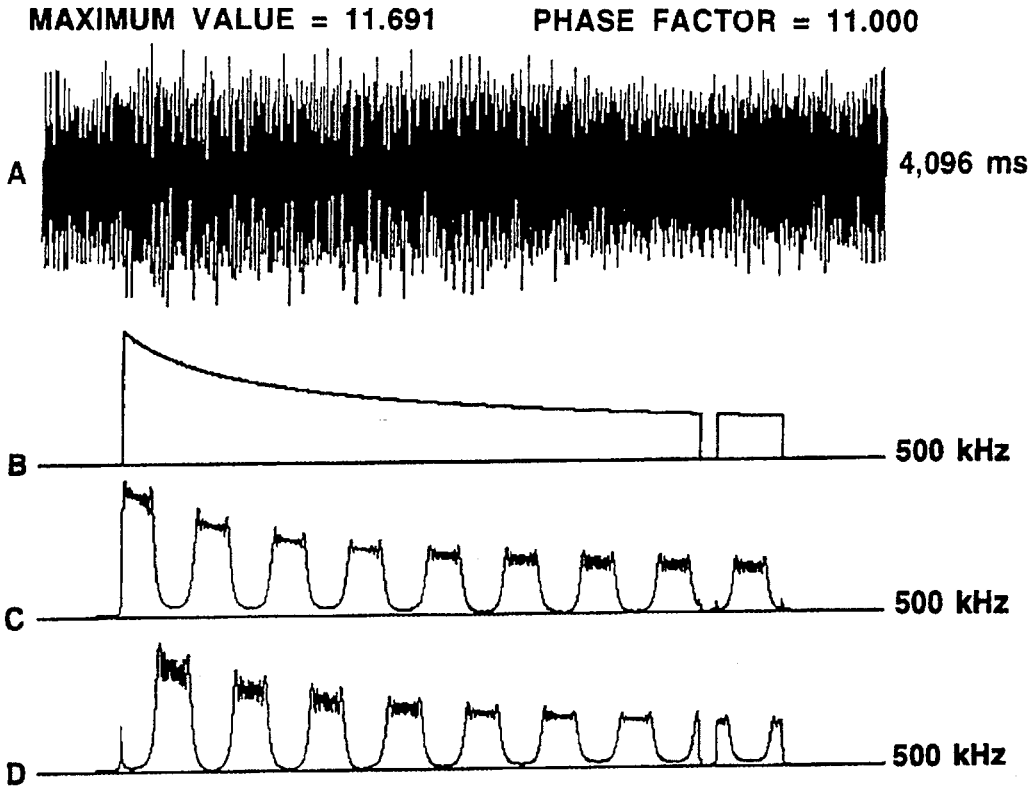
FIG. 3 presents a waveform period with phase factor 11, where the sweep is cycle smeared 11 times over the waveform period.
Figure 4:
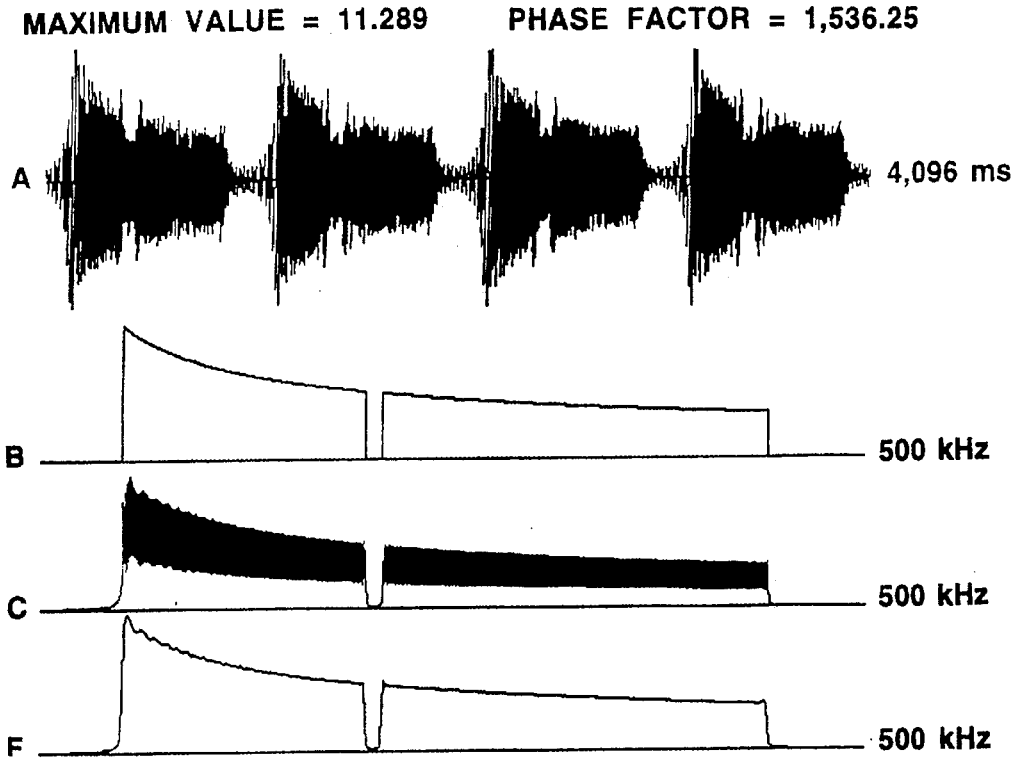
FIG. 4 shows the effect of phase factor $p=(3\times4096+1)/8$, whereby four separate sweeps are generated in the four quarters of the waveform period.
Figure 5:
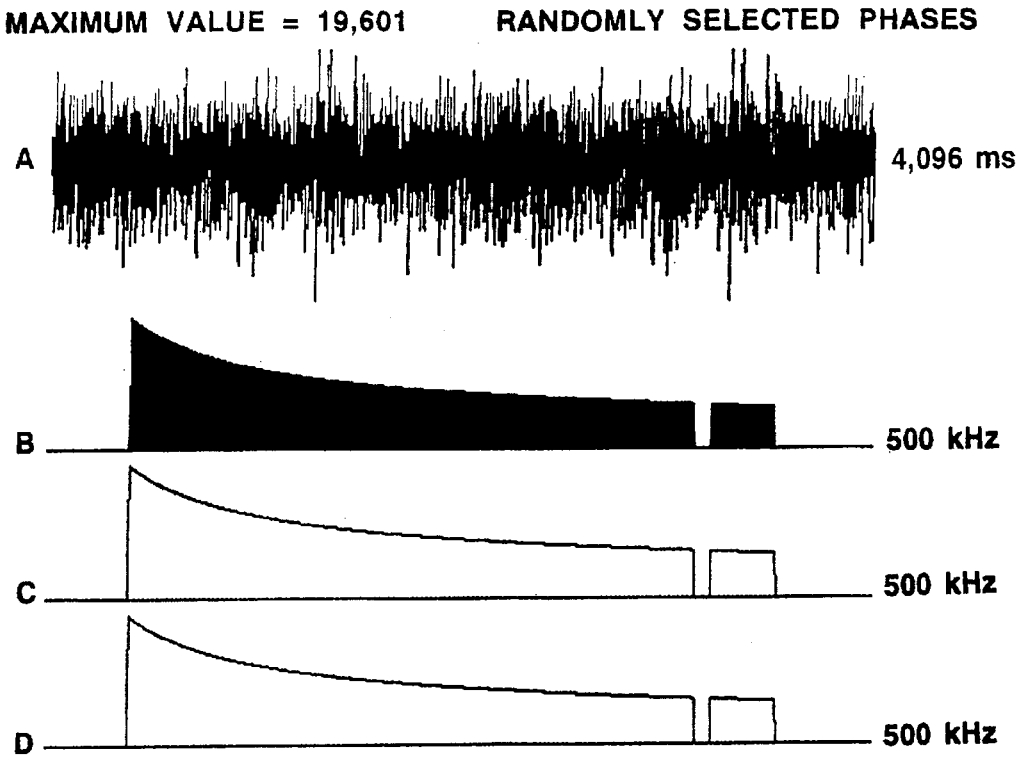
FIG. 5 shows a similar result for a comb structure of the original frequency spectrum.

Also the FIGS. 3 to 5 do not represent optimum cases in the sense of this invention, they only show disadvantages of the state of the art.

FIG. 3 demonstrates the effects of an enlarged phase factor.

Track A in FIG. 3 again shows the frequency mixture. It was generated by a phase factor p of 11 and therefore seems to be much more consistent than in FIG. 2. A frequency sweep is no longer in evidence.

Track B again shows the perfect Fourier analysis of the total interval.

Tracks C and D in FIG. 3 again show the Fourier analyses of the left and right-hand halves of the mixture. It becomes apparent that the frequencies are by no means evenly distributed over the interval but are neatly subdivided into 11 packages. In principle this applies to all large phase factors selected; however, if the values of the factors run into several thousands, a state is achieved whereby each package now only contains 1 to 2 frequencies so packaging no longer packs together neighboring frequencies, and the frequencies appear to be randomly distributed over the waveform period.

FIG. 4 shows the effect of phase factor $p=(3\times4096+1)/8$, whereby four separate sweeps are generated in the four quarters of the waveform period.

Track A in FIG. 4 shows the four frequency sweeps. Each sweep contains ¼ of all the frequencies.

Track B again shows the perfect Fourier analysis of the total interval.

Track C in FIG. 4 shows the Fourier analysis of the left-hand half of the mixture. The black portion is generated by the amplitude behavior of the frequencies. The amplitudes fluctuate subsequently between full amplitude and zero because every second frequency is absent.

Track F in FIG. 4 shows a Fourier analysis of only the third quarter of the waveform period. It is evident that virtually all the frequencies are present. Since the Fourier analysis, however, only covers one quarter of the points, it is courser and shows only the values of one frequency in four on the original frequency spectrum. FIG. 4 thus shows clearly that the analysis of the halves (or even of the quarters) of the waveform period cannot guarantee that the frequencies will be distributed uniformly over the waveform period.

FIG. 5 shows a similar result for a comb structure of the original frequency spectrum. A frequency structure was selected in which only one frequency in two is present. The frequencies in between are missing and their amplitudes have the value zero. The phases of the frequencies were selected at random this time.

Track A in FIG. 5 shows the frequency mixture. At first glance there is no special feature. Taking a closer look it is evident that the portion of curve in the left-hand half is exactly repealed in the right-hand half. This division of the curve is a result of inverse Fourier analysis, which is bound to be caused by the comb structure.

Track B in FIG. 5 shows the Fourier analysis of the total interval. The amplitude values of the frequency here always fluctuate between zero and the amplitude set because one frequency in two is missing; due to the lack of graphic resolution the area appears black.

Tracks C and D in FIG. 5 again show the Fourier analyses of the left and right-hand halves of the waveform period. The results are bound to be the same. Since analysis in each case is only half as fine, the missing frequencies are not shown and the areas are not black. Similar results can be obtained if only part of the frequency range is given a comb structure.

Again it becomes apparent that a comb structure with subsequent analysis of the two halves does not allow any statement to be made regarding the temporally uniform presence of all the frequencies, and that all the inclusions in this respect are false.

Figure 6:
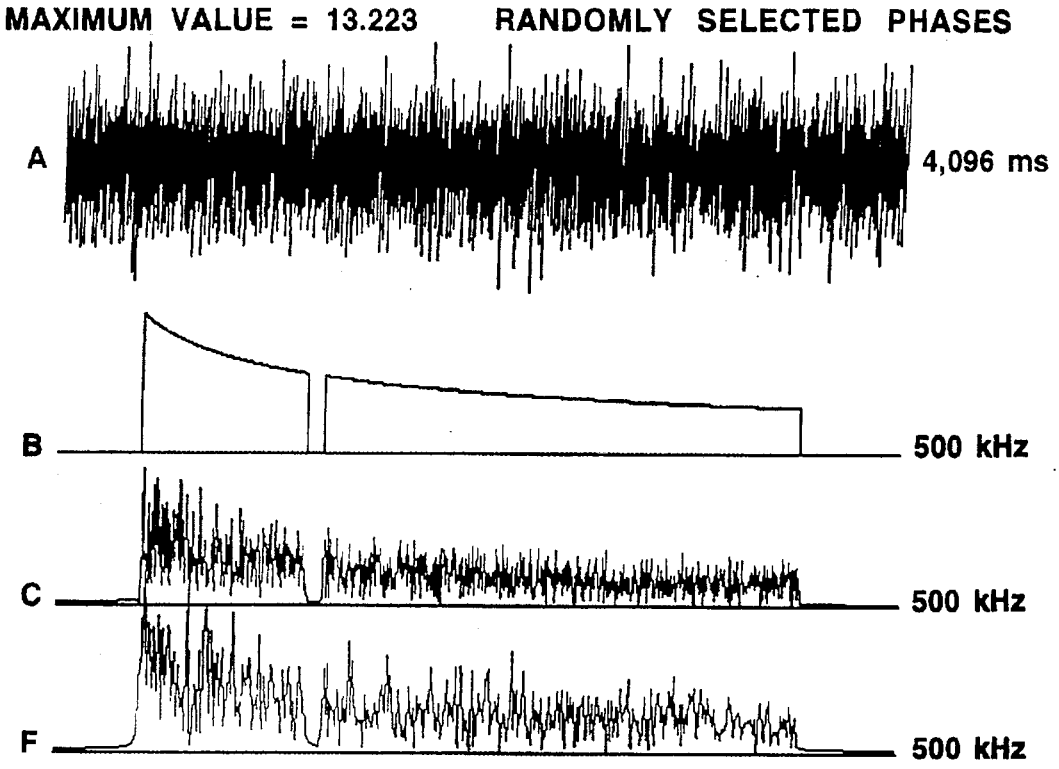
FIG. 6 shows the effects of randomly selected phases. By contrast with the statement in U.S. Pat. No. 5,324,939 the presence of the frequencies is consistent over the waveform period.

FIG. 6 shows the effects of randomly selected phases. By contrast with the statement in U.S. Pat. No. 5,324,939 the presence of the frequencies is consistent over the waveform period, the waveform is much better suited to continuously excite the ions inside the ion trap.

Track A shows the mixture, track B shows the perfect Fourier analysis of the total interval. Track C shows a Fourier analysis of the left-hand half whilst track F shows one of the third quarter of the waveform period. The much greater noise of tracks C and F is a necessary consequence of the uniform presence and there are only ever smooth tracks if statistical effects are canceled out by packaging.

Figure 7:
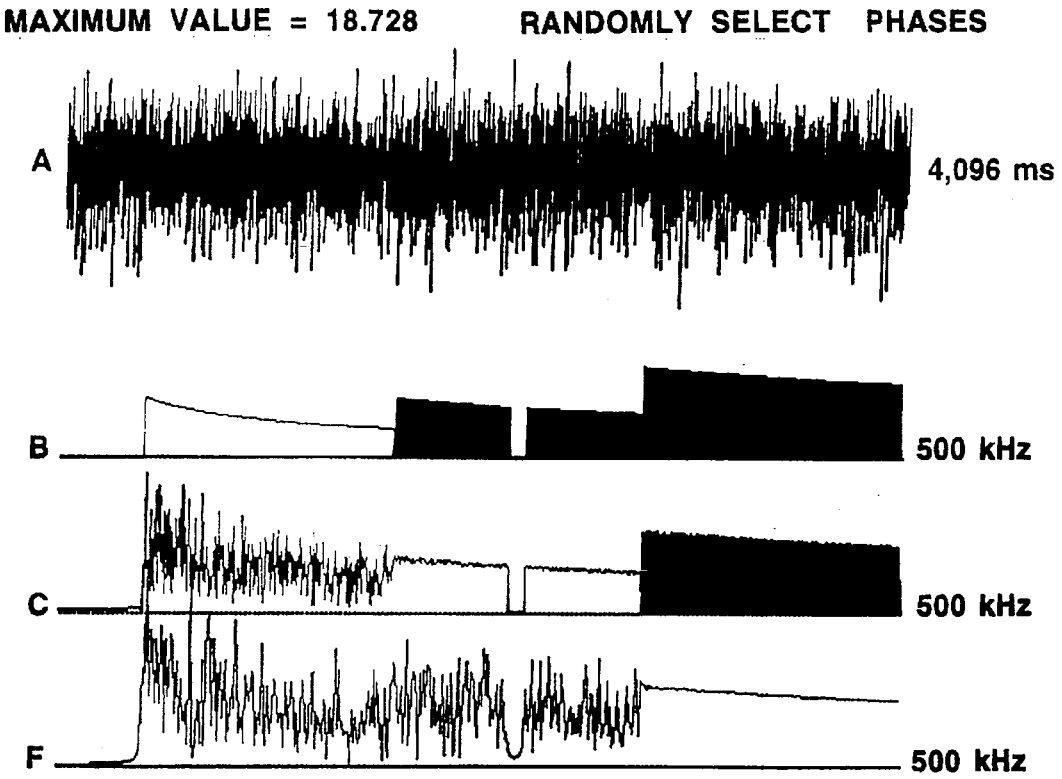
FIG. 7 demonstrates a favorable waveform used for exciting the undesired ions for ejection from the ion trap during ion generation.

FIG. 7 shows the particularly favorable case, in the sense of this invention, of a stepwise change of the frequency spacing, with compensation of the changing energy density by corresponding changes in amplitude. The phases again are selected randomly.

Track A shows the waveform period of the frequency mixture.

Track B shows the Fourier analysis of the mixture over the entire waveform period. Since from 200 kHz up the frequency spacing was halved and from 350 kHz up it was quartered, this range shows a comb structure of the frequencies which in this case appears black throughout due to graphic resolution. However, the respective doubling of the amplitude is apparent, superimposed with the dependency on the root of mass.

Track C shows the Fourier analysis of the left-hand half of the frequency interval. Since only one frequency in two is represented, at 200 kHz it is only the amplitude shift but not the transition to the comb structure that is visible. Only from 350 kHz up is the comb structure visible because here only one frequency in four is present in the frequency mixture.

Track F shows the Fourier analysis of the third quarter of the frequency interval. The smooth structure as of 350 kHz indicates that the frequencies above 350 kHz are repeatedly output exactly for times in the waveform period. The light ion masses are ejected very quickly, firstly because due to the larger frequency spacing less transitions to adjacent frequencies are necessary, and secondly because the frequency sequence is output four times per waveform period so four transitions of the continued excitation to adjacent frequencies can also take place.

FIG. 7 is an example of a largely optimal frequency mixture. The waveform period is only one millisecond long. The gap for the selected loading of a selected ion species is approx. 250 kHz, i.e. in the most favorable range for storage just beyond the range which is possibly disturbed by nonlinear resonances. The phases were chosen at random. Small masses were ejected at optimal speed by doubling the frequency spacing at 200 kHz and quadrupling at 350 kHz. The amplitudes were increased in each step by a factor of 1.4.

Preferred Embodiments

The invention described here is illustrated by a method of storing ions in a Paul RF ion trap, without restricting the invention to that particular case. Application to other purposes and other types of ion trap can easily be undertaken by any expert.

For the mass selective loading of ions, but also for other experiments using excitation of ions, it is chiefly only the mass range between 2.5 times the mass and 5 times the mass at the stability border which can be employed in RF ion traps. In the range between the stability border and 2.5 times the border mass, all the experiments are jeopardized by the presence of nonlinear instabilities. These nonlinear instabilities can be found in all commercially available ion traps—they are a consequence of arbitrary distortions in the ion traps which are necessary for good ejection behavior during spectrum scanning. For ion masses above 5 times the border mass the pseudo potential well in the ion trap is so shallow that storage becomes much more unfavorable. This limit of 5 times the border mass, however, is only a very vague limit because it is also possible to store ions beyond it.

The cut-off mass of the stability border can be set as required by the amplitude of RF storage voltage so in principle any ions can be stored in the optimal range. Storage of several ions in the optimal range simultaneously is also possible as long as the masses do not differ by much more than a factor of 2.

Therefore, in the following, the behavior of an ion will be examined, which has a mass of 200 u, in an ion trap which is set so that all the ions below a mass of 40 u are in the instable range. The mass of 40 u constitutes the cut-off mass at the stability border. If the ion trap is operated at a drive frequency of one megahertz, an ion with a mass of 200 atomic mass units (u) oscillates at the secular frequency estimated to be roughly 100 kilohertz. With respect to mass resolution during loading this ion constitutes the worst case.

For a mass resolution of 1 atomic mass unit a frequency spacing of 0.5 kHz at this frequency of 100 kHz is required in order to excite all the ions simultaneously whereby the resonance profiles must overlap. This mass resolution thus allows for a waveform period of only 2 milliseconds duration. In the 2 millisecond waveform period, the frequencies of 100.0 and 100.5 kHz differ by precisely one cycle, as required by the mass resolution. The two frequencies in the waveform period just consist of exactly 200 and 201 oscillation cycles respectively.

For storing ions at the lower end of the optimal mass range only a frequency spacing of 1 kHz is necessary. The required waveform period for the mixture in that case is only one millisecond.

The short duration of the waveform periods of only one to two milliseconds is extremely favorable because the mixture can then be output cyclically during ionization very frequently.

For the ejection of ions in the mass range above masses 100 and 200 u the frequency spacing is retained but the amplitude is increased in order to broaden the resonance profile. If the resonance profile is broadened considerably, e.g. to several mass units, a transition of the excitation to adjacent frequencies is no longer necessary for ion ejection. If all the masses up to 2,000 u are to be eliminated, the frequency range down to 10 kHz must be included in the mixture.

Loading of high masses can, as is already known, be also prevented by a DC voltage superimposed on the RF storage voltage. However, this DC voltage also reduces the potential depth in the usable range and should be avoided if possible.

If the method from DE 4 316 737 is used, for an ion trap with a drive frequency of 1 MHz, the output rate of frequency values of the mixture can be reduced to exactly this 1 MHz. Consequently, for the frequency mixture of a waveform period lasting only 1 millisecond, only 1,000 values have to be calculated and stored. For a memory requirement of 2 bytes per amplitude value the memory required is exceptionally low, only 2 kilobytes to store the full waveform period, and the memory has not to be fast.

In calculating a mixture by addition of individual sine waves it is advantageous to first disregard the gaps. During operation of measurement procedures, these waveform period with gaps can easily be generated from the base mixture by subtracting the sine-wave curves constituting the gaps. If a total of 10 sine-wave curves have to be subtracted for a gap with a width of about 5 u, the normal computation time is only about 20 milliseconds so it can be performed in real-time between two scans.

However, this cumbersome calculation of mixtures from individual sine-wave curves is unnecessary. By applying "Inverse Fast Fourier Transform" (IFFT) methods the frequency mixtures for the waveform periods can be calculated much faster. Calculation of a mixture waveform from any number of frequencies with the minimum spacing of one kilohertz and a length of 1,024 values (waveform interval duration 1,024 milliseconds) takes only a few milliseconds. In IFFT calculations the phases can also be selected at random. Nevertheless, it is also easy to use other types of phase dependencies, e.g. the dependency on the square of frequency with a selected phase factor. It is also possible to introduce different frequency spacing and different amplitudes to the IFFT computations.

When using IFFT methods it is not worth making mixtures without gaps in advance. The computations take place so quickly that dedicated mixtures can be calculated each time. In particular, special forms of amplitude dependency on frequency can be taken into account. It has thus become useful to keep the amplitude near the gaps relatively small and to increase them in proportion to distance from the gaps.

Computation takes place as follows: first of all the phases are selected at random (using a random generator). Second, the amplitude function is used to calculate the real and imaginary portions of all the frequencies used in the frequency domaine. The values are fried in memory.

Third, the IFFT algorithm generates the amplitude values in the time domaine, again as real and imaginary numbers. Due to the symmetry of the method, either the real or imaginary numbers can be used as the amplitude values of the waveform period.

Cyclic output of the amplitude values to the digital-to-analog converters can take place very simply if the values are stored in such a manner that the addresses are also in a power-of-two block. If the address values are subjected to appropriate logic filters, a cyclic run can be generated with continuous incrementation of the addresses, as any expert knows.

It is particularly advantageous to increase the frequency spacing toward higher frequencies. Due to the condition of integer oscillation cycles for each waveform period this possibility is limited though. The spacing can only be doubled, tripled, or quadrupled. Then the light ion masses are ejected at a particularly high speed, firstly because less transitions to adjacent frequencies are necessary due to the increase in frequency spacing, and secondly because the frequency sequence for these frequencies is output a number of times per waveform period on account of the doubling, tripling or quadrupling, and so several transitions of further excitation to next frequencies can take place per waveform period. For this stepwise increase in frequency spacing it is favorable to also stepwise change the amplitudes. This method is particularly advantageous for investigating heavier ions in processes which involve generation of excess quantities of small molecules, e.g. pyrolyses or explosive reactions. The presence of light ion species, even if only for a limited period, has a retarding effect on the loading of larger ions. The lighter ions are damped very fast and so they very soon form a small cloud at the center of the ion trap. The space charge of this cloud then prevents loading of larger ions.

This method is not much different if an ion of mass 2,000 u has to be stored at a stability border of 400 u because here the resonance amplitudes, measured on the frequency scale, are very similar. Mass resolution, however, is 10 times worse in this case. All the other conditions remain constant.

As already mentioned above, the storage requirement is only 2 kilobytes if 1,024 values with a width of 16 bit have to be stored. Output of the frequency mixture limited to 1,024 milliseconds can take place cyclically for as long as it seems necessary. After the ionization phase irradiation of the ions by the frequency mixture has to continue a while in order to eliminate all the undesired ions generated at the last moment of ionization. There are no disturbances because all the frequencies in the mixture follow on from each other without any phase jumps.

To terminate irradiation by the frequency mixture without any disturbation of the stored ions by interfering frequencies generated by the sharp ceasing, the amplitude of the mixture must be smoothly run down to zero which can be performed by controlling the degree of amplification by the output amplifier. This process is called "apodization".

For the mass selective loading of desired ions species, the isolation of the ions in the loading process has too coarse a mass resolution to end up with the desired ions only. Undesired ions of similar masses are stored together with the desired ions, and have to be removed in a second step of better mass resolution.

For the second step of enhanced isolation of the ions it is easy to use a much higher mass resolution. At this point in time the ion trap is no longer overfilled so the mass resolution is no longer restricted by space charge. The ions, damped by the collision gas in the ion trap, are at the center of the ion trap in the form of a small cloud so there is no shift in the resonance frequency due to field distortion. Frequency spacing can now be kept smaller. A spacing of 0.125 kHz, for example, produces a mass resolution of 0.25 mass units, thus enabling a clear separation of undesirable adjacent masses. However, here too one should note that transitions of resonance to adjacent frequencies must be possible.

The example of a frequency resolution of 0.125 kHz calls for a waveform period of 8.192 milliseconds, for which the frequency mixture has to be calculated. This is still very sparing with memory and computation time. At a word width of 16 bit, 16 kilobytes of memory are required and computation also now generally takes only a few tens of a seconds if FFY methods are used.

To ensure that the enhanced mass resolution in this second step is also effective, the amplitudes of the waveform mixture for the irradiation must be very low. Only if the average time for ejection of the remaining undesirable ion is also approx. 8 milliseconds or longer the desired resolving power can be achieved effectively. Generally speaking, ejection times must be longer to obtain optimal conditions.

Electronic amplification, which determines the voltage of the frequency mixture at the electrodes of the ion trap, and thus also the residence time of the ions in the trap, is best determined empirically and calibrated for both steps.

For the second step it is advantageous to keep the amplitudes free of frequency interference by apodizing carefully in the manner described above, both at the beginning and end.

Selection of the optimal parameters is completely different for the second step if the ions have a higher mass for which a much higher relative resolving power is required. For a mass resolution of 0.3 u for ions with a mass of 2,000 u, which oscillate with 200 kHz, a frequency resolution of 0.03 kHz is necessary. For this the length of the repeatable waveform period must be about 32 milliseconds. Memory required rises to 64 Kbyte. For computation it is advisable to use the IFFT method again. Computation time is still much less than one second.

The previous description relates completely to digital storage of the numeric sequence of amplitude values of the frequency mixture. However, electronic methods and modules have also become known for the analogous storage of voltages with fast readout times. The method can therefore just as well be used with analogous storage of the frequency mixture.

We claim:

1. A Method of generating a broadband signal of arbitrarily long duration T, consisting of superimposed discrete frequencies with given amplitudes and phases, for the simultaneous excitation of the oscillations of ions with various mass-to-charge ratios in an ion trap operated by an RF drive voltage, the method consisting the step of generating a cyclicly repeated output, for the duration T and without any time delay between the repetitions, of a short, non-apodized, stored voltage waveform period of short duration t via an output amplifier to at least one of trap electrodes, in which short waveform period all discrete frequencies have each an exactly integer number of frequency periods.

2. The method as in claim 1, whereby the short voltage waveform period of duration t is stored electrically in an analog form and is output to at least one of the trap electrodes via the output amplifier.

3. The method as in claim 1, whereby the short waveform period of duration t is stored as a sequence of digital amplitude values, and the sequence is output via a digital-to-analog converter and the output amplifier to at least one of the trap electrodes.

4. The method as in claim 3, whereby the output via the digital-to-analog converter is controlled such that there is fed, to at least one of the trap electrodes, exactly one amplitude value per cycle of the RF drive voltage of the ion trap, or an integer multiple of amplitude values per RF cycle.

5. The method as in claim 4, whereby the short duration t of the stored waveform has a maximum time length of 4096 cycles of the RF drive frequency of the ion trap.

6. The method as in claim 4, whereby the short duration t has a length of 1024 cycles of the RF drive frequency of the ion trap.

7. The method as in claim 3, whereby the sequence of amplitude values of the stored waveform is calculated by adding discrete sine wave values of given amplitudes and phases regarding the condition for the frequency cycles given in claim 1.

8. The method as in claim 3, whereby the sequence of amplitude values of the stored waveform is calculated by inverse Fourier transform (FFT) from a given frequency profile with given amplitudes and phases in the frequency domaine.

9. The method as in claim 8, whereby the phases are selected randomly.

10. The method as in claim 1, whereby the broadband signal of long duration T is apodized by increasing the amplitudes, in the beginning of the signal, smoothly from zero to full amplitudes, and/or, at the end of the signal, by decreasing the amplitudes smoothly from full amplitudes to zero, preferrably by simple amplification control of the output amplifier.

* * * * *